United States Patent [19]

Mitsuyama

[11] Patent Number: 5,062,530

[45] Date of Patent: Nov. 5, 1991

[54] COMPACT FILE FOR LETTERS AND OTHER DOCUMENTS

[76] Inventor: Masuhiro Mitsuyama, 1071, Kinugasa, Wake-cho, Wake-gun, Okayama, Japan

[21] Appl. No.: 530,397

[22] Filed: May 30, 1990

[30] Foreign Application Priority Data

Feb. 20, 1990 [JP] Japan ..... 2-16421[U]

[51] Int. Cl.[5] ..... B65D 85/00; B65D 27/08

[52] U.S. Cl. ..... 206/425; 40/359; 229/1.5 R; 229/71; 229/72; 383/39

[58] Field of Search ..... 383/39, 106, 40; 150/147, 145, 149; 229/68 R, 71, 72, 1.5 R; 40/359; 206/425

[56] References Cited

U.S. PATENT DOCUMENTS

| | | | |
|---|---|---|---|
| 404,584 | 6/1889 | Williamson . | |
| 501,431 | 7/1893 | Lambert | 150/149 |
| 912,110 | 2/1909 | Gill . | |
| 1,051,198 | 1/1913 | Collins . | |
| 1,670,343 | 5/1928 | Clemens . | |
| 1,857,488 | 5/1932 | Weeks . | |
| 1,908,115 | 5/1933 | Chadwick . | |
| 2,741,572 | 4/1956 | Lennartz . | |
| 2,763,311 | 9/1956 | Sparrow . | |
| 2,828,975 | 4/1958 | Wright | 150/147 X |
| 2,832,467 | 4/1958 | Schade | 40/359 |
| 2,871,153 | 1/1959 | Coper | 150/147 X |
| 2,920,671 | 1/1960 | Siris et al. | 383/106 X |
| 3,086,572 | 4/1963 | Lubin | 383/39 X |
| 3,154,125 | 10/1964 | Harvey | 229/1.5 R |
| 3,224,640 | 12/1965 | Schnerder et al. | 383/40 X |
| 3,360,027 | 12/1967 | Price | 229/72 X |
| 3,435,868 | 4/1969 | Stermer | 383/39 X |
| 3,530,961 | 9/1970 | Weissenbach | 383/39 X |
| 3,659,640 | 5/1972 | Fenster et al. | 150/147 |
| 3,899,127 | 8/1975 | Melander | 229/71 X |
| 3,958,690 | 5/1976 | Gee, Sr. . | |
| 4,388,458 | 6/1983 | Dworkin | 229/72 |
| 4,477,013 | 10/1984 | Herrin | 229/71 X |
| 4,895,198 | 1/1990 | Samuelson | 383/39 X |

OTHER PUBLICATIONS

IBM Technical Disclosure Bulletin, vol. 18, No. 5, Oct. 1975.

*Primary Examiner*—Bryon P. Gehman

*Attorney, Agent, or Firm*—Wenderoth, Lind & Ponack

[57] ABSTRACT

Disclosed is a file for holding various kinds of documents or letters, which is constructed essentially of a rigid rectangular main plate, a cover and soft pliable portions provided along at least the longitudinal side edges of the main plate. The cover sheet is dimensioned so as to cover the main plate and the soft pliable portions and is fused to the pliable portions and bottom end of the main plate. The top end of the cover sheet is left separable from the main plate so that papers or letters can be inserted or removed. The structure of the file is such that when the file is empty, the cover sheet is closely adjacent the main plate since no separation member is disposed between the main plate and the cover sheet. This makes the file very flat and convenient to transport. Nevertheless, when it is desired to open the file, the cover sheet can merely be pulled forwardly, whereby the pliable portions bend forwardly and papers or letters can be inserted into or removed from the pocket formed between the main plate and the cover sheet.

12 Claims, 2 Drawing Sheets

FIG.7 - PRIOR ART

COMPACT FILE FOR LETTERS AND OTHER DOCUMENTS

BACKGROUND OF THE INVENTION

1. Field of the Invention

This invention relates generally to a compact file, and more specifically, to a compact file for holding letters or other documents.

2. Description of the Prior Art

FIG. 7 shows a conventional letter file, which is constructed of a back plate 11, a front plate 12 and a narrow separation plate 13 which connects the back and the front plates to each other at their longitudinal sides and their bottom ends. A pocket 14 for holding letters or postcards is formed between the back and the front plates with the narrow separation plate disposed therebetween. Plastic-laminated cardboard and the like is often used for the plates 11, 12, 13.

In such conventional letter files, however, the front plate 12 tends to sag forwardly when only a few letters are in the file, thereby resulting in a poor appearance. Also, since the front plate 12 is separated from the back plate by the width of the separation plate 13, these letter files are bulky and inconvenient to transport. Moreover, it is necessary that the plates 11, 12, 13 be adhered to one another at many locations, such that assembly thereof is overly time consuming, thereby resulting in increased manufacturing costs.

SUMMARY OF THE INVENTION

Accordingly, an object of the invention is to provide a file without a separation plate and to solve all of the above-mentioned problems resulting therefrom.

In order to solve the problems, the present invention is embodied, in accordance with a first embodiment, as a file in which soft pliable portions of a certain width are provided along both longitudinal sides of a main plate. A cover sheet dimensioned so as to cover the main plate and the soft pliable portions is mounted thereon and fused to bottom end of the main plate and to the pliable portions thereof.

In a second embodiment, a file is provided with soft pliable portions of a certain width along both longitudinal sides of a main plate, and a cover sheet, which is dimensioned so as to cover the main plate and the soft pliable portions, is mounted thereon and fused to the soft pliable portions on both the longitudinal sides and the top and bottom ends of the main plate. An opening for insertion of papers or documents is provided in the upper part of the cover sheet.

In a third embodiment, a file is provided with soft pliable portions of a certain width along both longitudinal sides and top and bottom ends of a main plate, and a cover sheet which is dimensioned so as to cover the main plate and the pliable portions is mounted thereon and fused to all of the pliable portions. An opening for the insertion of papers or documents is provided at the upper part of the cover sheet.

In the first embodiment, by pulling the upper end of the cover sheet forwardly, the soft pliable portions on both longitudinal sides of the main plate bend forwardly to allow a space to be formed between the main plate and the cover sheet. Thereby, letters or documents can be inserted into the pocket through the space.

In the second embodiments, by pulling the cover sheet forwardly at a portion thereof adjacent the lower end of the opening, the pliable portions on both longitudinal sides or on every peripheral edge of the main plate bend forwardly to allow a space to be formed between the main plate and the cover sheet. Thereby, letters or document can be inserted into the pocket through the space.

BRIEF DESCRIPTION OF THE DRAWINGS

FIG. 7 is a perspective view of a conventional letter file.

DETAILED DESCRIPTION OF THE INVENTION

Figure 3:
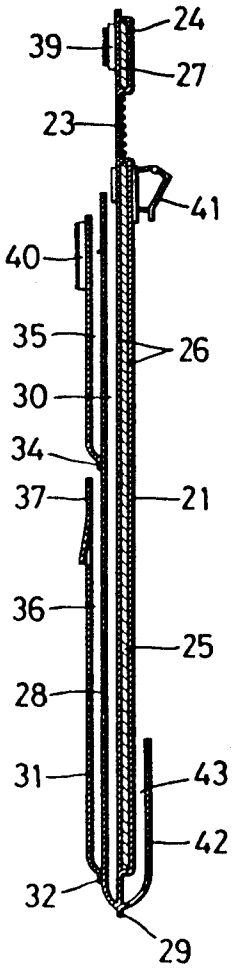
FIG. 3 is a longitudinal cross-sectional view of the file of FIG. 1 taken along line III—III.
Figure 2:
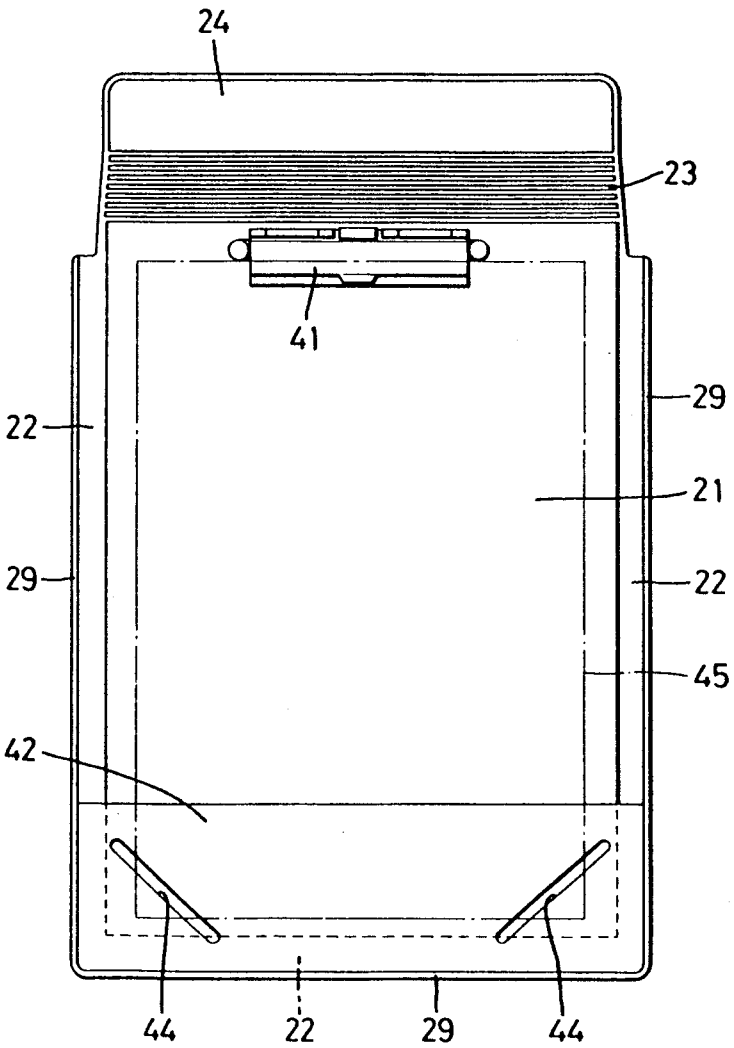
FIG. 2 is a rear view of the file shown in FIG. 1.

In a first example of the invention, as shown in FIGS. 1 to 4, a vertically elongated, rectangular rigid plate 21 is provided with soft pliable portions 22, 22, 22 along its longitudinal sides and its bottom end. A pliable portion 23 is provided along a top end of the plate 21 and acts to connect the plate 21 to a closure portion 24.

The plate 21 is preferably formed by laminating both faces of a rigid rectangular board (or rigid member) 25 with plastic sheets 26. That is, both the faces of the hard board 25 are covered with plastic sheets 26 whose size is greater than the board 25, such that the sheets 26 can be fused to one another by heating along their peripheral edges outwardly of the board 25. These fused peripheral edges of the sheets 26 form the pliable portions 22, 22, 22, 23. The closure portion 24 is formed by putting another board 27 between the sheets 26 at the upper ends thereof which extend well beyond the board 25, and then welding the two sheets 26 together along the periphery of the board 27.

A soft and pliable cover sheet 28 is mounted on the rigid plate 21. The cover sheet 28 is formed to a size that just covers the plate 21 and the pliable portions 22, 22, 22 on the three sides of the plate 21, and is fused to the pliable portions 22, 22, 22 by heating. In this way, a main pocket 30 that opens upwardly is formed between the cover sheet 28 and the plate 21.

In addition, a sheet 31 is fused to the cover sheet 28 by heating along its three sides 32, 32, 32. The sheet 31 includes a laterally elongated opening 33 at a longitudinally central portion thereof. The sheet 31 is fused, as shown at 34, along the periphery of the opening 33 to the cover sheet 31 so as to form upper 35 and lower 36 pockets.

In the illustrated example, a tongue 37 is formed on the sheet 31 extending upwardly from a lower periphery of the opening 33, and a slit 38 is formed in the cover sheet 31 in such a position as to receive the tongue 37 and thereby allow the pocket 36 to be closed.

A pair of fastening elements 39, 40, such as snaps (not shown) or hook and loop elements (see FIGS. 1 and 3), are attached at the upper part of the pocket 35 and the front surface of the closure portion 24, respectively, in order to allow the pockets 30 and 35 to be closed by mutual connection of the fastening elements 39, 40. A clip 41 is mounted to an upper part of the back surface of the rigid plate 21, and a narrow sheet 42 is mounted to a lower part of the back surface of the plate 21. The sheet 42 is fused to the pliable portions 22, 22, 22 with its upper side left open so as to form a rear pocket 42. Also, a pair of opposing slanted slits 44, 44 are formed on opposing sides of the narrow sheet 42, so that a paper 45 can be held firmly with its upper end caught by the clip 41 and its lower end disposed in the pocket 43 with its lower corners inserted through the slits 44, 44.

Figure 1:
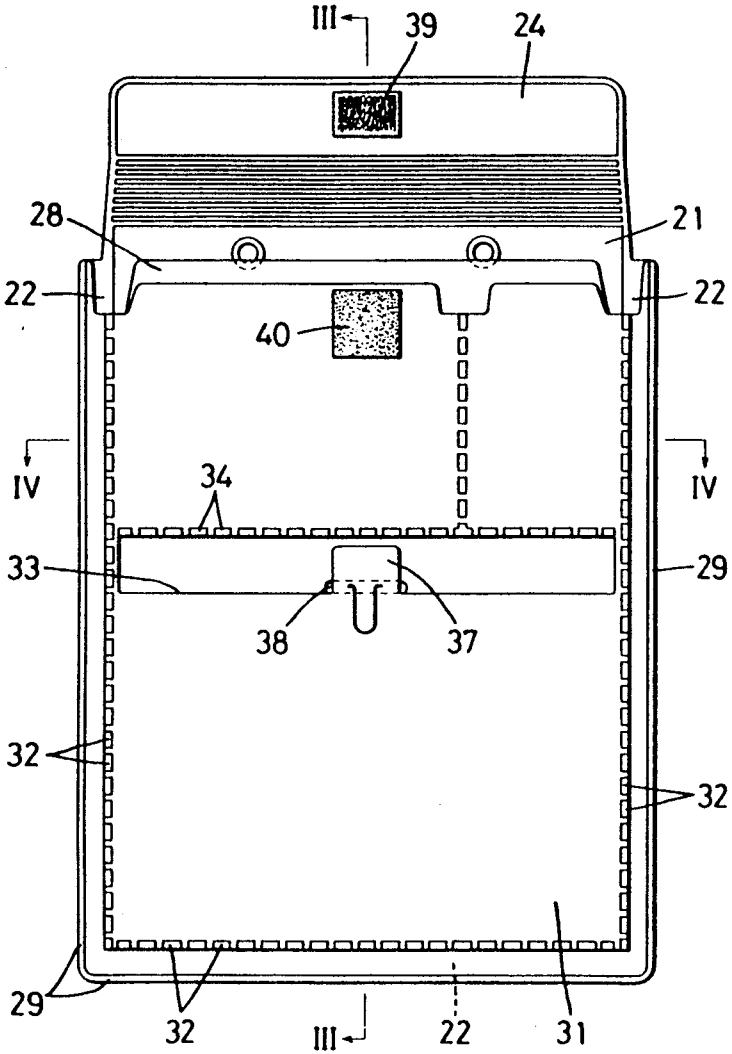
FIG. 1 is a front view of a file according to a first example of the invention.
Figure 4:
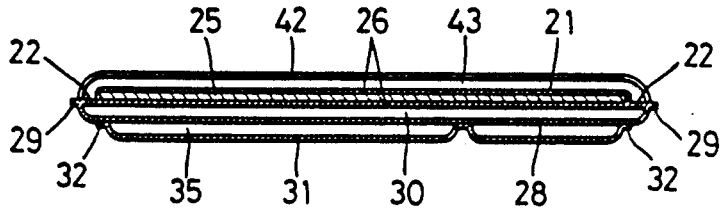
FIG. 4 is a lateral cross-sectional view of the file of FIG. 1 taken along line IV—IV.

As shown in FIG. 1, the cover sheet is substantially stretched between the two longitudinal sides of the rigid plate 21 such that substantially no vertically extending folds are present in the cover sheet.

Any suitable rigid board can be used as the board 25 to define the plate 21 of the first example, provided that it is enclosed with a plastic sheet or with plastic sheets fused together at their peripheries with adhesives so as/to form soft pliable portions. Also, the rear pocket 43 can be made deeper by using a wider sheet extending as far upwardly as the upper end of the rigid plate 21.

Moreover, although.not shown in the drawings, aligned vertically elongated openings can be provided in the pockets 35, 36 so as to connect the two pockets in the vertical direction. With this device, a card disposed in either of the pockets 35, 36 can be removed easily by pushing upwardly against the card with a finger extending through one of the respective openings.

The file according to the first example of this invention has a structure which, when empty, allows the file to lay flat as a whole because the plate 21, the cover sheet 28 and the pocket sheet 31 are all stacked closely together, as shown in FIG. 3.

When it is desired to put a paper in the main pocket 30, the upper end of the cover sheet 28 can be pulled forwardly so as to open the pocket. At that time, the pliable portions 22, 22 on both longitudinal sides of the file bend forward with the forward pulling of the cover sheet 28 and a space is formed between the plate 21 and the sheet 28 which will allow paper to be placed in the main pocket 30.

Figure 6:
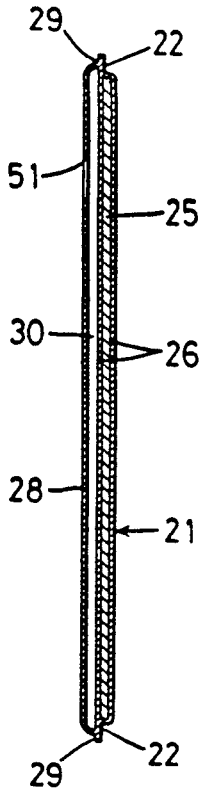
FIG. 6 is a longitudinal cross-sectional view of the file of FIG. 5 taken along line VI—VI.
Figure 5:
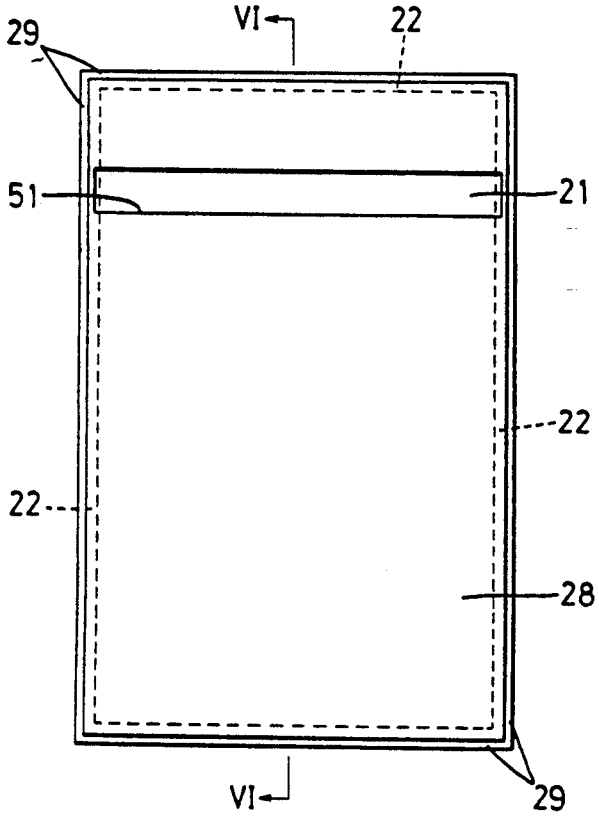
FIG. 5 is a front view of a file according to a second example of the invention.
Figure 5:
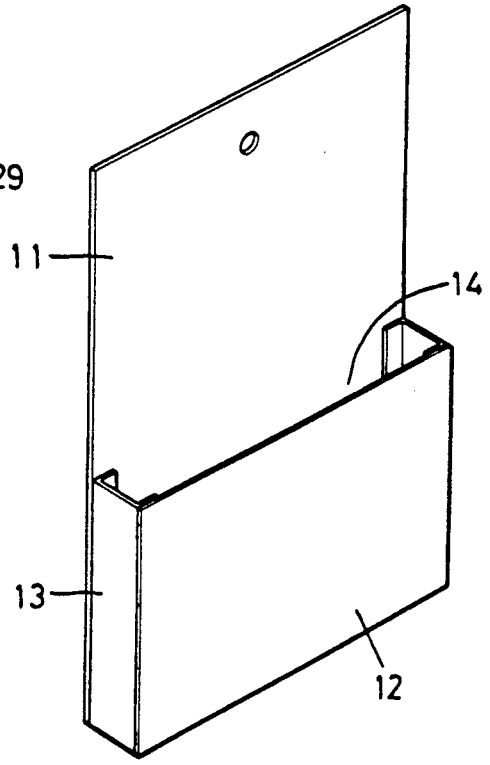

With reference to FIGS. 5 and 6, a second example of this invention will now be described below in detail. In this example, the same numbers and the same symbols as those in the first example, shown in FIGS. 1 to 4, are to be allotted to portions corresponding to those of the first example.

As shown in FIGS. 5 and 6, soft pliable portions 22 are provided along every peripheral edge of a rigid main rectangular plate 21. A cover sheet 28', which is dimensioned so as to cover both the plate 21 and all the pliable portions 22, is mounted on the plate 21 and fused to all the pliable portions as shown at 29.

A laterally elongated opening 51 is formed in the upper part of the cover sheet 28 and defines an opening for a main pocket 30 formed between the plate 21 and the cover sheet 28'.

In this second example, the cover sheet 28 can be formed slightly shorter in the vertical direction than the plate 21, and the bottom and two side peripheral portions of the cover sheet 28 are fused to the pliable portions 22 of the plate 21 at both longitudinal sides and the bottom end so that the main pocket 30 can open upwardly and be formed between the plate 21 and the cover sheet 28'.

In the file of the second example, the plate 21 and the cover sheet 28' are so closely superposed on one another that the produced file is very flat as a whole. And, when it is desired to place a paper in the pocket 30, the portron or sheet 28' at the lower side of the opening 51 can only be pulled forwardly.

As the portion of sheet 28' at the lower side of the opening 51 is pulled forwardly, the pliable portions 22 on both longitudinal sides bend forwardly and provide a space through which the paper can be inserted.

Although the first and the second examples of the invention have been described as useful for holding documents, they can of course be useful for holding letters.

As stated above, according to the invention, it is unnecessary to interpose a separation plate between the plate 21 and the cover sheet 28, 28'. Because of this, the file is less bulky and very flat, which is not only convenient for transporting purposes but also results in a reduction in production costs.

By the direct fusing of the cover sheet to the soft pliable peripheral portions of the rigid main hard plate, papers or letters can be very easily placed in the pocket that opens between the cover sheet and the main hard plate. Moreover, because the pliable peripheral portions of the plate always tend to return to their flat positions, the cover sheet is always being pulled toward the plate and so will not lean forward like the front plate of conventional files when even just a few papers or letters are in the file. Therefore, the file of the present invention maintains a nice appearance.

What is claimed is:

1. A file comprising:

a rigid plate having a top edge, a bottom edge, two side edges, a front surface and a rear surface;

a cover sheet having a top edge, a bottome dge, and two side edges, said cover sheet being attached along its two side edges to said two side edges, respectively, of said rigid plate, said cover sheet further being attached along its bottom edge to said bottom edge of said rigid plate but being separable along said top edge of said cover sheet from said rigid plate, such that said cover sheet is adjacent said front surface of said rigid plate and a pocket is formed between said rigid plate and said cover sheet;

said rigid plate comprising a flat rigid member, and means mounted to said rigid member for allowing a space to be formed between said top edge of said rigid plate and said top edge of said cover sheet when said rigid plate is held firmly and said top edge of said cover sheet is pulled forwardly away from said rigid plate; and said means for allowing a space to be formed comprises pliable portions attached to said rigid member and extending laterally outwardly therefrom along both side edges thereof, said side edges of said cover sheet being attached along said pliable portions such that, when said rigid plate is held firmly and said top edge of said cover sheet is pulled forwardly away from said rigid plate, said pliable portions bend forwardly to allow said top edge of said cover sheet to move forwardly relative to said rigid plate.

2. A file as recited in claim 1, wherein said cover sheet is substantially stretched between said two side edges of said rigid plate such that substantially no vertically extending folds are present in said cover sheet.

3. A file as recited in claim 2, wherein said rigid plate comprises a front plastic sheet mounted against a front surface of said rigid member, and a rear plastic sheet mounted against a rear surface of said rigid member, said front and rear plastic sheets extending laterally beyond both of two opposing side edges of said rigid member and being attached together along two opposing side edges of said front and rear plastic sheets; and said pliable portions of said rigid plate are defined by the portions of said front and rear plastic sheets which extend laterally outwardly of said side edges of said rigid member.

4. A file as recited in claim 3, wherein said front and rear plastic sheets are fused together along their opposing side edges.

5. A file as recited in claim 2, further comprising an additional sheet having a top edge, a bottom edge and two side edges, said side edges and bottom edge of said additional sheet being attached therealong to said side edges and said bottom edge, respectively, of said cover sheet, such that an additional pocket is formed between said cover sheet and said additional sheet;

wherein a laterally elongated opening is formed in a vertically central portion of said additional sheet; and wherein said additional sheet is further attached to said rigid plate along an upper periphery of said laterally elongated opening, such that said additional pocket comprises upper and lower pockets.

6. A file as recited in claim 2, wherein said front and rear plastic sheets extend upwardly beyond a top edge of said rigid member so as to form a closure portion which can be folded downwardly over said top edge of said cover sheet.

7. A file as recited in claim 2, further comprising a rear sheet having a top edge, a bottom edge and two side edges, said side edges and bottom edge of said rear sheet being attached therealong to said side edges and said bottom edge, respectively, of said rear surface of said rigid plate so as to form a rear pocket.

8. A file as recited in claim 1, wherein said rigid plate comprises a front plastic sheet mounted against a front surface of said rigid member, and a rear plastic sheet mounted against a rear surface of said rigid member, said front and rear plastic sheets extending laterally beyond both of two opposing side edges of said rigid member and being attached together along two opposing side edges of said front and rear plastic sheets; and said pliable portions of said rigid plate are defined by the portions of said front and rear plastic sheets which extend laterally outwardly of said side edges of said rigid member.

9. A file as recited in claim 8, wherein said front and rear plastic sheets are fused together along their opposing side edges.

10. A file as recited in claim 1, further comprising an additional sheet having a top edge, a bottom edge and two side edges, said side edges and bottom edge of said additional sheet being attached therealong to said side edges and said bottom edge, respectively, of said cover sheet, such that an additional pocket is formed between said cover sheet and said additional sheet;

wherein a laterally elongated opening is formed in a vertically central portion of said additional sheet; and wherein said additional sheet is further attached to said rigid plate along an upper periphery of said laterally elongated opening, such that said additional pocket comprises upper and lower pockets.

11. A file as recited in claim 1, wherein said front and rear plastic sheets extend upwardly beyond a top edge of said rigid member so as to form a closure portion which can be folded downwardly over said top edge of said cover sheet.

12. A file as recited in claim 1, further comprising a rear sheet having a top edge, a bottom edge and two side edges, said side edges and bottom edge of said rear sheet being attached therealong to said side edges and said bottom edge, respectively, of said rear surface of said rigid plate so as to form a rear pocket.

* * * * *